US010297193B2

(12) United States Patent
Hwang et al.

(10) Patent No.: US 10,297,193 B2
(45) Date of Patent: May 21, 2019

(54) ORGANIC LIGHT-EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Heechul Hwang, Yongin (KR); Joohyung Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 363 days.

(21) Appl. No.: 14/741,341

(22) Filed: Jun. 16, 2015

(65) Prior Publication Data

US 2016/0133172 A1 May 12, 2016

(30) Foreign Application Priority Data

Nov. 10, 2014 (KR) ..... 10-2014-0155521

(51) Int. Cl.
*G09G 3/32* (2016.01)
*G09G 3/3233* (2016.01)

(52) U.S. Cl.
CPC ... *G09G 3/3233* (2013.01); *G09G 2300/0842* (2013.01); *G09G 2320/0295* (2013.01); *G09G 2320/045* (2013.01)

(58) Field of Classification Search
CPC ..... G09G 3/3233; G09G 2320/043; G09G 2320/045; G09G 2360/16; G09G 3/3291; G09G 2320/029; G09G 2320/0233; G09G 3/3208; G09G 3/3258
USPC ..... 345/76, 77, 204, 212, 690, 207
See application file for complete search history.

(56) References Cited

U.S. PATENT DOCUMENTS

| | | | | |
|---|---|---|---|---|
| 6,525,683 | B1 | 2/2003 | Gu | |
| 7,868,857 | B2 * | 1/2011 | Nathan | G09G 3/3241 345/690 |
| 8,242,989 | B2 | 8/2012 | Kwon | |
| 8,288,784 | B2 | 10/2012 | Cho | |
| 9,401,110 | B2 | 7/2016 | Lee et al. | |
| 9,601,051 | B2 | 3/2017 | Shin | |
| 9,786,221 | B2 | 10/2017 | Bae et al. | |
| 2003/0063081 | A1 | 4/2003 | Kimura et al. | |

(Continued)

FOREIGN PATENT DOCUMENTS

| | | | |
|---|---|---|---|
| CN | 1754198 | A | 3/2006 |
| CN | 1804977 | A | 7/2006 |

(Continued)

*Primary Examiner* — Alesa Allgood
(74) *Attorney, Agent, or Firm* — Lewis Roca Rothgerber Christie LLP

(57) ABSTRACT

An organic light-emitting display device includes: a display panel comprising a plurality of pixels, wherein each of the plurality of pixels comprises an organic light-emitting diode (OLED) configured to emit light of one color from among a plurality of colors comprising red, green, and blue; a degradation determiner configured to determine a degree of degradation of the OLED from a value of accumulated image data that is input to each of the plurality of pixels; a current sensor configured to apply a sensing voltage to the OLED and to measure a current corresponding to the sensing voltage; and a degradation calculator configured to calculate an amount of degradation of the OLED from the current measured by the current sensor.

12 Claims, 7 Drawing Sheets

(56) References Cited

U.S. PATENT DOCUMENTS

| | | | | |
|---|---|---|---|---|
| 2004/0257312 | A1 | 12/2004 | Koyama et al. | |
| 2006/0158397 | A1 | 7/2006 | Goh | |
| 2006/0238943 | A1* | 10/2006 | Awakura | G09G 3/3258 361/93.1 |
| 2010/0020107 | A1* | 1/2010 | Chui | G09G 3/005 345/690 |
| 2011/0169802 | A1* | 7/2011 | Yamashita | G09G 3/3291 345/211 |
| 2014/0329339 | A1* | 11/2014 | Chaji | G01R 31/26 438/10 |
| 2015/0070339 | A1* | 3/2015 | Ahn | G09G 3/3233 345/211 |
| 2015/0091884 | A1* | 4/2015 | Yang | G09G 3/3283 345/205 |

FOREIGN PATENT DOCUMENTS

| | | | |
|---|---|---|---|
| CN | 101488319 | A | 7/2009 |
| CN | 102024844 | A | 4/2011 |
| CN | 103871358 | A | 6/2014 |
| JP | 2000-315070 | A | 11/2000 |
| JP | 2004-38209 | A | 2/2004 |
| KR | 10-2008-0060890 | A | 7/2008 |
| KR | 10-2011-0078716 | A | 7/2011 |
| KR | 10-2013-0067092 | A | 6/2013 |
| KR | 1020160034511 | A | 3/2016 |
| KR | 1020160044133 | A | 4/2016 |

* cited by examiner

ORGANIC LIGHT-EMITTING DISPLAY DEVICE AND METHOD OF DRIVING THE SAME

CROSS-REFERENCE TO RELATED APPLICATION

This application claims priority to and the benefit of Korean Patent Application No. 10-2014-0155521, filed on Nov. 10, 2014, in the Korean Intellectual Property Office, the disclosure of which is incorporated herein in its entirety by reference.

BACKGROUND

1. Field

One or more example embodiments relate to an organic light-emitting display device and a method of driving the same.

2. Description of the Related Art

Various flat panel display devices that are far lighter and thinner than cathode ray tubes have recently been developed. Examples of flat panel display devices include liquid crystal display (LCD) devices, field emission display (FED) devices, plasma display panel (PDP) devices, and organic light-emitting display devices.

Organic light-emitting display devices that are flat panel display devices using an organic compound that emits light display an image by using an organic light-emitting diode that generates light through recombination between electrons and holes.

Organic light-emitting display devices have characteristics of a fast response time, low power consumption, a high brightness, a high color purity, and a thin and light design, and thus are expected to be used as various display devices including portable display devices.

An organic light-emitting display device includes a plurality of pixels that represent one color from among colors including red, green, and blue, and emits light at a brightness corresponding to a data voltage applied to each of the plurality of pixels.

Each of the plurality of pixels includes an organic light-emitting diode (OLED) and a pixel circuit that is coupled to a data line and a scan line and controls the OLED. The OLED emits light at a brightness corresponding to a driving current that is supplied from the pixel circuit.

The pixel circuit may include a plurality of transistors and storage capacitors, and controls the driving current that is supplied to the OLED in response to a data signal that is applied to the data line when a scan signal is applied to the scan line.

In this case, the pixels of the organic light-emitting display device may not display an image at a desired brightness due to a change in efficiency as the OLED is degraded. Actually, as time passes, the OLED may become degraded, and thus light may be generated at a lower brightness in response to the same data signal.

SUMMARY

One or more example embodiments relate to an organic light-emitting display device and a method of driving the same. According to some embodiments, of the present invention, an organic light-emitting display device and a method of driving the same may compensate for degradation without initial degradation data by calculating an amount of degradation of an organic light-emitting diode (OLED) by using currents that are measured in a degraded pixel and a non-degraded pixel.

One or more example embodiments include an organic light-emitting display device and a method of driving the same which may reduce the effect of noise on a display operation to determine an amount of compensation corresponding to a brightness decline due to degradation of an organic light-emitting diode (OLED).

Additional aspects will be set forth in part in the description which follows and, in part, will become more apparent from the description, or may be learned by practice of the presented embodiments.

According to one or more example embodiments, an organic light-emitting display device includes: a display panel including a plurality of pixels, wherein each of the plurality of pixels includes an organic light-emitting diode (OLED) configured to emit light of one color from among a plurality of colors including red, green, and blue; a degradation determiner configured to determine a degree of degradation of the OLED from a value of accumulated image data that is input to each of the plurality of pixels; a current sensor configured to apply a sensing voltage to the OLED and to measure a current corresponding to the sensing voltage; and a degradation calculator configured to calculate an amount of degradation of the OLED from the current measured by the current sensor.

The degradation determiner may include a memory configured to store a value of image data that is input to each of the plurality of pixels, and the degradation determiner may be configured to determine the degree of degradation of the OLED from the value of the image data stored in the memory.

The degradation calculator may be configured to calculate a background current based on a current that is measured in a non-degraded pixel from among the plurality of pixels.

The degradation calculator may be configured to calculate the amount of degradation based on a difference between the background current and a current that is measured in a degraded pixel from among the plurality of pixels.

The organic light-emitting display device may further include a degradation compensator configured to apply compensation data corresponding to the amount of degradation to a degraded pixel.

The degradation determiner may be configured to separate a degradation area and a non-degradation area from the value of the accumulated image data that is input to each of the plurality of pixels.

The degradation calculator may be configured to calculate the amount of degradation of the OLED by using currents that are measured at a same time.

According to one or more example embodiments, in a method of driving an organic light-emitting display device, the organic light-emitting display device including a plurality of pixels, wherein each of the plurality of pixels includes an organic light-emitting diode (OLED) configured to emit light of one color from among a plurality of colors including red, green, and blue, the method includes: storing image data that is input to each of the plurality of pixels; determining a degree of degradation of the OLED from the image data; applying a sensing voltage to the OLED; measuring a current corresponding to the sensing voltage; and calculating an amount of degradation of the OLED from the measured current.

The calculating of the amount of degradation may include calculating a background current from a current that is measured in a non-degraded pixel from among the plurality of pixels.

The calculating of the amount of degradation may include calculating the amount of degradation from a difference between the background current and a current that is measured in a degraded pixel from among the plurality of pixels.

The method may further include applying compensation data corresponding to the amount of degradation to a degraded pixel.

The determining of the degree of degradation may include separating a gradation area and a non-degradation area from a value of the accumulated image data that is input to each of the plurality of pixels.

The calculating of the amount of degradation may include calculating the amount of degradation of the OLED by using currents that are measured at a same time.

BRIEF DESCRIPTION OF THE DRAWINGS

These and/or other aspects will become apparent and more readily appreciated from the following description of the example embodiments, taken in conjunction with the accompanying drawings in which.

DETAILED DESCRIPTION

Figure 1:
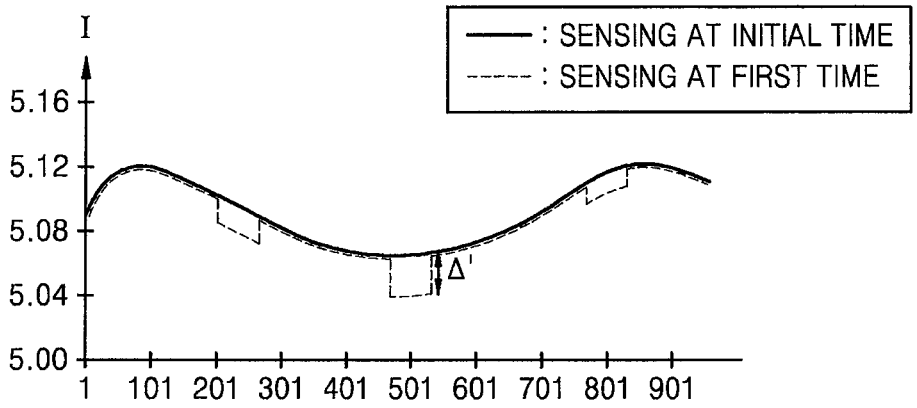
FIG. 1 and FIGS. 2A and 2B are graphs for explaining a method of calculating an amount of degradation by using a current that is measured at an initial time, according to an example embodiment.

Aspects of the present invention may include various example embodiments and modifications, and example embodiments thereof will be illustrated in the drawings and will be described herein in some detail. The aspects and features of the present invention and methods of achieving the aspects and features will be described more fully with reference to the accompanying drawings, in which example embodiments of the present invention are shown. The present invention may, however, be embodied in many different forms and should not be construed as being limited to the example embodiments set forth herein.

Reference will now be made in detail to example embodiments, examples of which are illustrated in the accompanying drawings. In the drawings, the same elements are denoted by the same reference numerals, and a repeated explanation thereof will not be given.

As used herein, the singular forms "a", "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

It will be understood that although the terms "first", "second", etc. may be used herein to describe various elements, these elements should not be limited by these terms. These elements are only used to distinguish one element from another. It will be further understood that the terms "comprises" and/or "comprising" used herein specify the presence of stated features or components, but do not preclude the presence or addition of one or more other features or components.

As used herein, the term "and/or" includes any and all combinations of one or more of the associated listed items. Expressions such as "at least one of," when preceding a list of elements, modify the entire list of elements and do not modify the individual elements of the list.

Figure 2A:
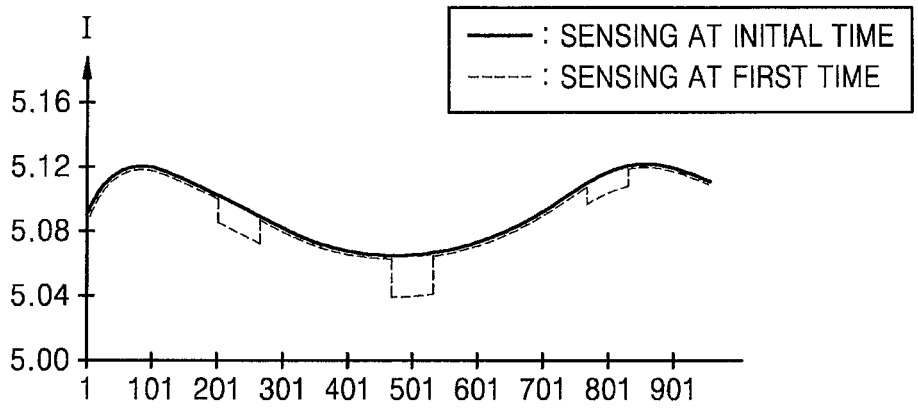
Figure 2B:
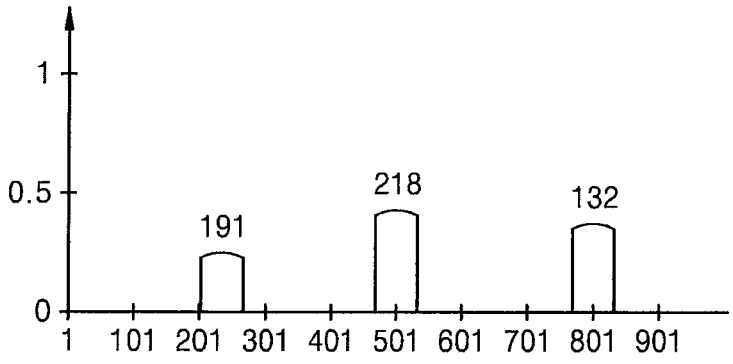

FIG. 1 and FIGS. 2A and 2B are graphs for explaining a method of calculating an amount of degradation by using a current that is measured at an initial time, according to an example embodiment.

FIG. 1 illustrates currents that are measured in a plurality of pixels that are arranged in one row of a display unit of an organic light-emitting display device. Although the plurality of pixels, for example, 1080 pixels, are arranged in one row of the display unit in FIG. 1, a number of pixels that are included in the display unit is not limited to a specific value.

FIG. 1 illustrates currents that are measured at different times. In FIG. 1, one curve shows a current that is measured at an initial time when the organic light-emitting display device is measured, and the other curve shows a current that is measured after a period of time (e.g., a predetermined period of time) elapses from an instant or point in time when the organic light-emitting display device is driven.

Also, each current is obtained by measuring a current that flows between both ends of an organic light-emitting diode (OLED) that is included in each of the plurality of pixels.

Referring to FIG. 1, the current that is measured at the initial time and the current that is measured after the period of time (e.g., a predetermined period of time) elapses have a greater difference in a specific interval than in other intervals.

Some OLEDs of the plurality of pixels are degraded as a time for which the OLEDs are driven increases. Once an OLED is degraded, efficiency is reduced, and thus even when a data voltage having the same magnitude as that of a previous one is applied, light is emitted at a lower brightness, thereby failing to display a desired image or reducing image quality.

A current that is measured by applying a voltage having a magnitude (e.g., a predetermined magnitude) to the degraded OLED is less than a current that is measured by applying a voltage having the same magnitude as the magnitude (e.g., the predetermined magnitude) to a non-degraded OLED. This is because as the degraded OLED is degraded, an internal resistance increases.

Accordingly, it may be determined that an interval in which a magnitude of a measured current is significantly less than those in other intervals in FIG. 1 is an interval including a degraded pixel.

Also, it may be determined that the degraded pixel is degraded by a difference A between a magnitude of the current that is measured at the initial time and a magnitude of the current that is measured after the period of time (e.g., the predetermined period of time) elapses from the instant or point in time when the organic light-emitting display device is driven.

FIG. 2A is a graph illustrating a current that is measured at an initial time and a current that is measured after a period of time (e.g., a predetermined period of time) elapses from an instant or point in time when the organic light-emitting display device is driven, like in FIG. 1. FIG. 2B is a graph illustrating an amount of degradation that is calculated from the graph of FIG. 2A and data that is applied to and accumulated in a pixel, according to an example embodiment.

Each pixel of the organic light-emitting display device includes the OLED that emits light at a brightness corresponding to a voltage of a current applied to the OLED, and also includes a pixel circuit that applies the voltage or the current to the OLED.

The pixel circuit receives a data voltage from the outside and supplies a driving current corresponding to the data voltage to the OLED. When a data voltage corresponding to a high gray scale is applied to the OLED, the OLED emits light at a high brightness, and when a data voltage corresponding to a low gray scale is applied to the OLED, the OLED emits light at a low brightness.

As a data voltage corresponding to a high gray scale is applied to a pixel and an amount of accumulated data increases, an amount of degradation of the OLED that is included in the pixel may increase. A magnitude of a current that is measured when the same voltage is applied to a degraded pixel is reduced, like in FIG. 1.

When an amount of degradation is determined by measuring a magnitude of a current, the amount of degradation is greatly affected by a temperature at a time when the current is measured. Assuming that a degree of degradation is determined by using magnitudes of currents that are measured at different times as shown in FIGS. 1 and 2A, if temperatures at the different times when the currents are measured are different from one another, the accuracy of the measurement is reduced.

FIG. 2B is a graph illustrating an amount of degradation that is calculated from a current that is measured from the graph of FIG. 2A, according to an example embodiment. FIG. 2B illustrates amounts of gradation in three areas, and values of data accumulated in the three areas are respectively 191, 218, and 132.

The values of data that are values of image data accumulated in pixels of the three areas may be gray scale values of the data.

It may be determined that in an area having a highest value of accumulated data, that is, in the area having the value of accumulated data of 218, the OLED is most seriously degraded and in an area having a lowest value of accumulated data, that is, in the area having the value of accumulated data of 132, the OLED is least seriously degraded.

However, an amount of degradation that is calculated from the graph of FIG. 2A is calculated to be the lowest in the area having the value of accumulated data of 191 and does not correspond to an amount of degradation that is estimated from the value of accumulated data.

That is, when an amount of degradation is measured based on currents that are measured at different times, the amount of degradation may not be accurately calculated due to the effect of a temperature.

Figure 3:
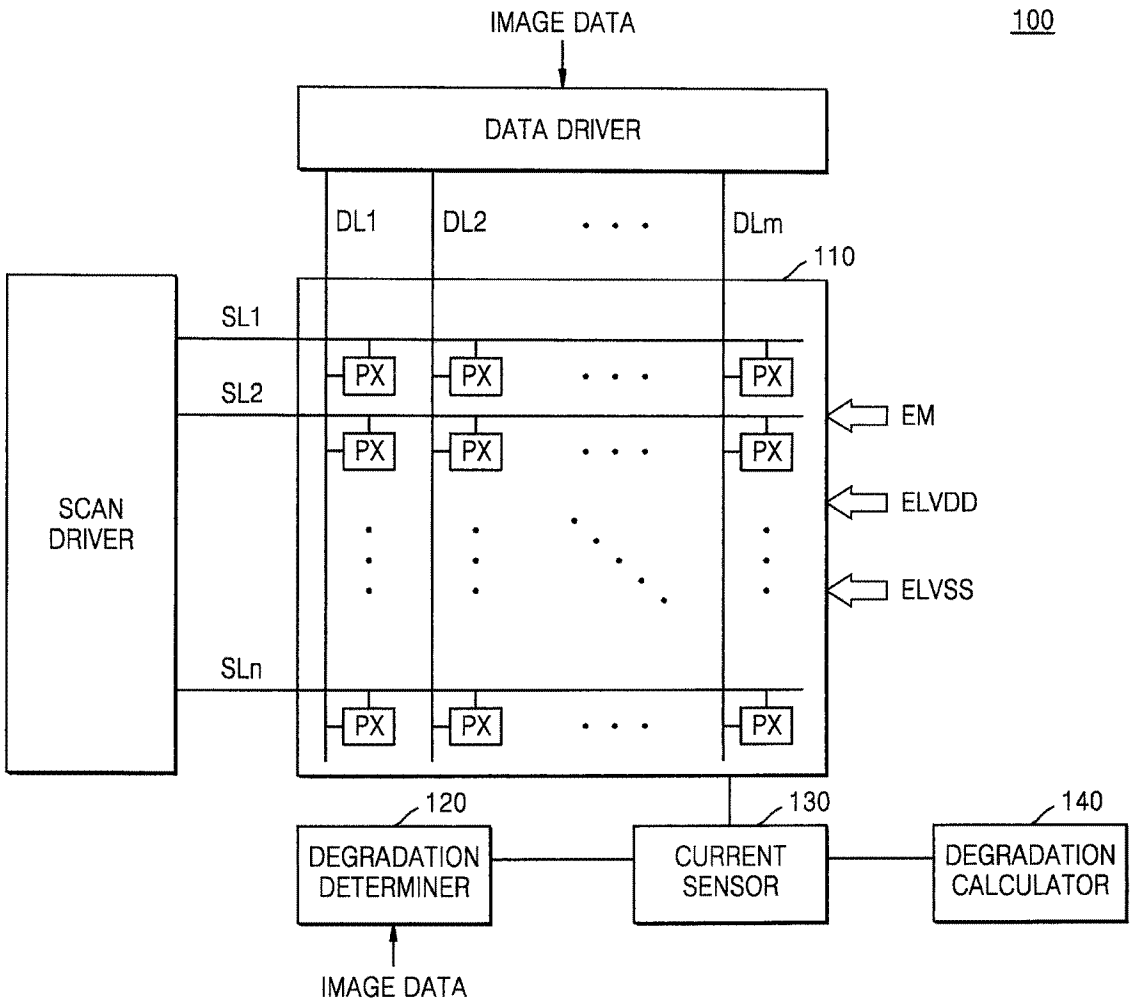
FIG. 3 is a block diagram illustrating a configuration of an organic light-emitting display device according to an example embodiment.

FIG. 3 is a block diagram illustrating a configuration of an organic light-emitting display device 100 according to an example embodiment.

The organic light-emitting display device 100 according to an example embodiment includes a display panel 110, a degradation determiner 120, a current sensor 130, and a degradation calculator 140.

The display panel 110 includes a plurality of pixels PX, and each of the plurality of pixels PX includes the OLED that emits light of one color from among a plurality of colors including red, green, and blue.

Also, the display panel 110 may be a light-emitting diode panel that operates by receiving a light-emitting signal EM, a driving voltage ELVDD, and a ground voltage ELVSS.

Each of the pixels PX may represent one color from among red, green, and blue, and a pixel representing red, a pixel representing green, and a pixel representing blue may be sequentially repeatedly arranged. A user may perceive light of one color obtained by combining red, green, and blue light that are represented by adjacent pixels PX.

Alternatively, the pixels PX may include a red pixel, a green pixel, a blue pixel, and a white pixel that are adjacent to one another.

Also, each of the plurality of pixels PX includes the OLED. When a data signal having a highest gray scale is applied to pixels representing red, green, and blue, red light, green light, and blue light each having a high gray scale that are emitted from the pixels PX may be combined with one another to be perceived as white light.

Alternatively, when a data signal having a high gray scale is applied to each of pixels that represent red and green and a data signal having a low gray scale is applied to a pixel that represents green, red light and green light having a high scale and blue light having a low gray scale that are output from the pixels may be combined with one another to be perceived as yellow light.

The plurality of pixels PX may be arranged at intersections between scan lines SL1 through SLn that are arranged in rows of the display panel 110 and data lines DL1 through DLm that are arranged in columns of the display panel 110. The plurality of pixels PX respectively receive scan signals and data signals from the scan lines SL1 through SLn and the data lines DL1 through DLm.

A data driver of FIG. 3 applies a data signal corresponding to image data to the plurality of pixels PX through the data lines DL1 through DLm in response to a data control signal.

Also, a scan driver receives a scan control signal and generates a scan signal. The scan driver may apply the generated scan signal to the plurality of pixels PX through the scan lines SL1 through SLn. The plurality of pixels PX of one row may be sequentially selected according to the scan signal and the data signal may be applied.

The degradation determiner 120 determines a degree of degradation of the OLED from a value of accumulated image data that is input to each of the plurality of pixels PX.

Each of the plurality of pixels PX receives a data signal corresponding image data from the data driver, and the degradation determiner 120 accumulates and stores the image data that is transmitted to each of the plurality of pixels PX according to the pixels PX.

The pixels PX may not display a desired image due to a change in efficiency as the OLED is degraded. Actually, as time passes, the OLED is degraded, and thus light is emitted at a lower brightness in response to the same data signal.

The degradation of the OLED is caused by stress as data applied to each pixel including the OLED is accumulated, and a degree of the degradation may increase as an amount of the accumulated data increases.

The degradation determiner 120 may include a memory that stores a value of accumulated image data that is input to each of the plurality of pixels PX that are included in the display panel 110, and may determine a degree of degradation of the pixel PX from the value of accumulated image data that is stored in the memory.

The memory may be a nonvolatile memory, and may accumulate and store data that is applied to the plurality of pixels PX that are included in the display panel 110.

The degradation determiner 120 may determine a degree of degradation of the OLED from the value of accumulated image data that is applied to the plurality of pixels PX, and may determine that the OLEDs that are included in pixels other than a pixel having a lowest value of accumulated image data are all degraded.

Alternatively, a degree of degradation from the value of accumulated image data may be divided into a number of levels (e.g., a predetermined number of levels, for example, 10 levels), and a pixel that is at a number of levels (e.g., a predetermined number of levels) having a low degree of degradation (for example, first and second levels) may be determined to be a non-degraded pixel.

Alternatively, the display panel 110 may be divided into a plurality of display areas, an average of values of data applied to pixels that are included in the plurality of areas may be calculated, and it may be determined that the OLEDs of pixels that are included in display areas other than a display area having a lowest average are degraded.

The current sensor 130 applies a sensing voltage to each OLED and measures a current corresponding to the sensing voltage.

In order to measure the current corresponding to the sensing voltage, the current sensor 130 applies the same sensing voltage having a magnitude (e.g., a predetermined magnitude) to the OLEDs of all of the pixels PX that are included in the display panel 110 and measures an output current corresponding to the sensing voltage.

As the OLED is degraded, an internal resistance increases and efficiency decreases. Accordingly, even when a voltage having the same magnitude as that of a previous one is applied, light may be emitted at a lower brightness. Also, as a degree of degradation increases, a current output when a voltage having the same magnitude as that of a previous one is applied further decreases.

When a sensing voltage having the same magnitude is applied to pixels that emit pieces of light of the same color, a magnitude of a current that is measured in a degraded pixel may be less than a magnitude of a current that is measured in a non-degraded pixel.

The degradation calculator 140 calculates an amount of degradation of the OLED from the current that is measured by the current sensor 130.

As described above, because as the OLED is degraded, a magnitude of a current that is measured by the current sensor 130 decreases, the current that is measured by the current sensor 130 may correspond to an amount of degradation of the OLED.

The degradation determiner 120 may determine a degree of degradation of the OLED that is included in each of the plurality of pixels PX, may compare currents that are measured in a pixel that is degraded (i.e., a degraded pixel) and a pixel that is not degraded (i.e., a non-degraded pixel), and may calculate an amount of degradation of the OLED that is included in the degraded pixel.

Figure 4:
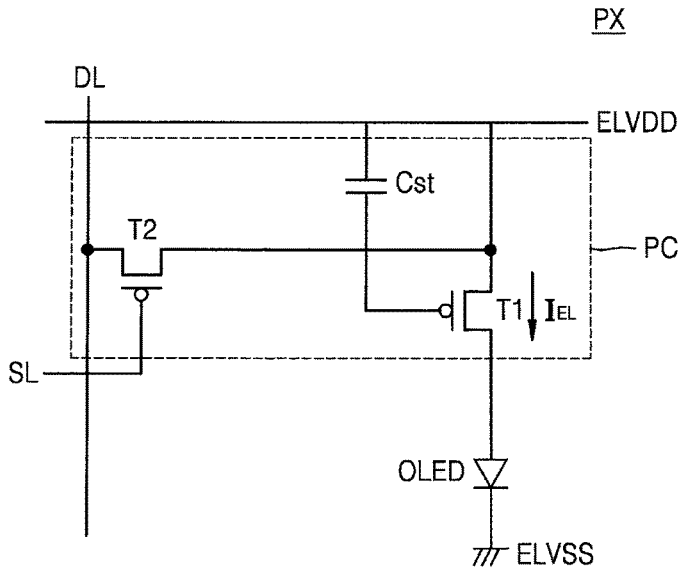
FIG. 4 is a diagram illustrating a configuration of a pixel circuit of the organic light-emitting display device, according to an example embodiment.

FIG. 4 is a diagram illustrating a configuration of a pixel circuit PC of the organic light-emitting display device 100, according to an example embodiment.

Referring to FIG. 4, each pixel PX of the organic light-emitting display device 100 includes the pixel circuit PC and the OLED, and the pixel circuit PC includes a driving transistor T1 and a switching transistor T2.

The switching transistor T2 includes a first electrode that receives a data signal that is applied from a data line DL and a second electrode that is coupled to a first electrode of the driving transistor T1.

The driving transistor T1 receives the data signal from the switching transistor T2 and outputs driving a current $I_{EL}$ corresponding to the data signal to the OLED.

Also, the first electrode of the driving transistor T1 receives the driving voltage ELVDD, and a second electrode of the driving transistor T1 is coupled to an anode of the OLED.

A gate electrode of the switching transistor T2 may be coupled to a scan line SL that applies a scan signal for transmitting the data signal to the driving transistor T1.

The pixel circuit PC may include a storage capacitor Cst, a first electrode of the storage capacitor Cst receives the driving voltage ELVDD, and a second electrode of the storage capacitor Cst is coupled to a gate electrode of the driving transistor T1.

The OLED emits light at a brightness corresponding to the driving current $I_{EL}$ that is transmitted from the driving transistor T1.

A cathode of the OLED is coupled to a line of a second driving voltage, the second driving voltage may be a reference voltage, and the reference voltage may be, for example, the ground voltage ELVSS.

As described above, as the OLED is degraded, even when a driving current having the same magnitude as that of a previous one is supplied from the driving transistor T1, light may not be emitted at a desired brightness.

The current sensor 130 may apply a sensing voltage having a magnitude (e.g., a predetermined magnitude) between the anode and the cathode of the OLED in order to calculate an amount of degradation of the OLED, and may measure a current output from the OLED corresponding to the sensing voltage.

The pixel circuit PC of FIG. 4 is an example, and each pixel PX of the organic light-emitting display device 100 is not limited to that of FIG. 4.

The pixel PX may further include one or more transistors or one or more capacitors in addition to the driving transistor T1, the switching transistor T2, and the storage capacitor Cst.

Figure 5:
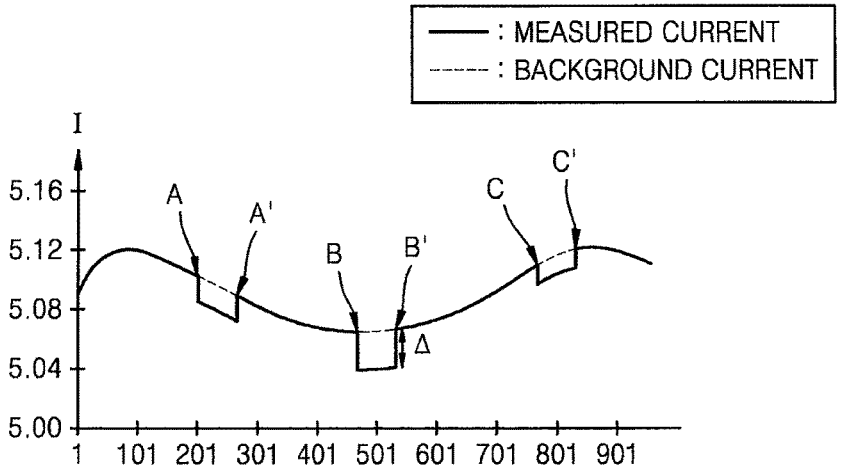
FIG. 5 is a graph for explaining a method of calculating an amount of degradation, according to another example embodiment.

FIG. 5 is a graph for explaining a method of calculating an amount of degradation, according to an example embodiment.

Referring to FIG. 5, there is a pixel area in which a magnitude of a current that is measured is sharply reduced when compared to other pixel areas.

The pixel area may be an area in which the OLED is degraded and a magnitude of a measured current is reduced.

As the OLED is degraded, an internal resistance of the OLED increases. Accordingly, even when a voltage having the same magnitude as that of a previous one is applied, light is emitted at a lower brightness. Also, a magnitude of a current that is measured in a degraded pixel is less than a magnitude of a current that is measured in a non-degraded pixel.

FIG. 5 shows three degraded areas. A dashed line (e.g., A-A', B-B', or C-C') that linearly couples two non-degraded pixels that are located at both ends of a degraded area indicates a background current. An amount of degradation Δ may be defined as a value obtained by subtracting the background current from a magnitude of a current that is measured in each pixel.

The background current refers to a current that is predicted to be measured even if a degraded pixel is not degraded. An amount of compensation of the degraded pixel may be determined to correspond to the amount of degradation Δ.

Although the background current linearly couples currents that are measured in non-degraded pixels located at both ends of a degraded area in FIG. 5 for convenience of calculation, the present example embodiment is not limited thereto and the background current may be a curve in consideration of variations in currents that are measured in the non-degraded pixels.

Since a current that is predicted to be measured if each pixel that is included in a degraded area is not degraded may be obtained by calculating the background current, the amount of degradation Δ and the amount of compensation may be obtained from a difference between the background current and the current that is measured in each degraded pixel.

The current sensor 130 applies a sensing voltage having a predetermined magnitude to each pixel that is included in the display panel 110, measures a current corresponding to the sensing voltage, and applies the measured current to the degradation calculator 140.

The degradation calculator 140 may calculate a background current from the measured current as described with reference to FIG. 5, and may calculate the amount of degradation Δ from a difference between the background current and a current that is measured in the pixels that are included in the degraded area.

Although a method of calculating a background current from pixels that are included in one row has been explained in FIG. 5, an amount of degradation of a degraded pixel that is included in a two-dimensional (2D) degraded area may also be calculated by using the method.

Also, when a background current is calculated, currents that are measured from non-degraded pixels located before and after a start coordinate and an end coordinate of a degraded area may be used, or currents that are measured from a plurality of non-degraded pixels may be used.

For example, a method of calculating a background current by using an average value of currents that are measured from 5 non-degraded pixels that are located before the start coordinate and an average value of currents that are measured from 5 non-degraded pixels that are located after the end coordinate may be used.

Although a degradation compensating system may determine an amount of compensation of a degraded pixel by using a difference between a current that is measured at an initial time and a current that is measured after a period of time (e.g., a predetermined period of time) elapses, the organic light-emitting display device 100 according to the present invention uses a difference between currents that are measured in a degraded pixel and a non-degraded pixel, and thus does not need initial data to compensate for degradation of the OLED.

Figure 6:
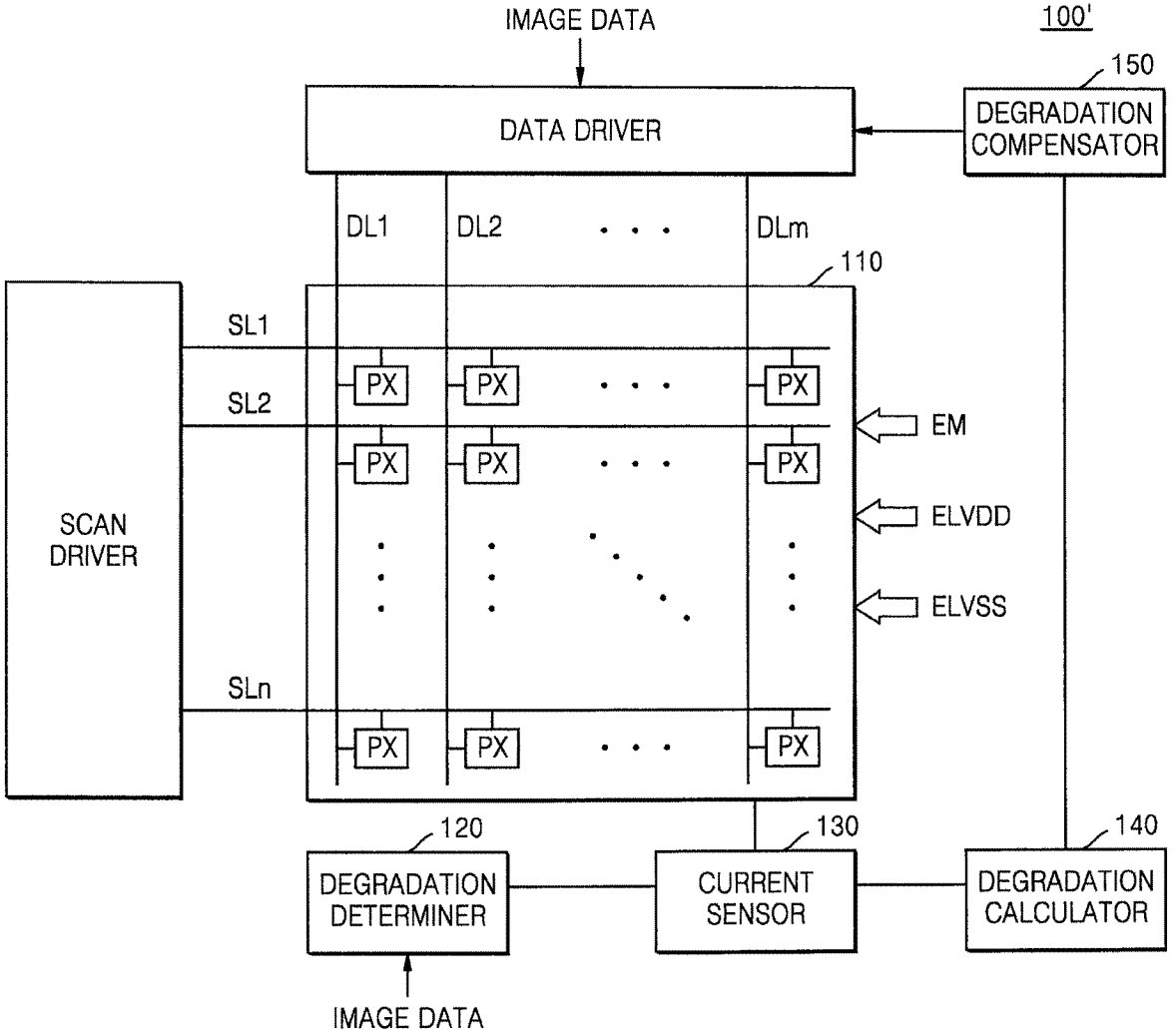
FIG. 6 is a block diagram illustrating a configuration of an organic light-emitting display device according to another example embodiment.

FIG. 6 is a block diagram illustrating a configuration of an organic light-emitting display device 100' according to another example embodiment.

Referring to FIG. 6, the organic light-emitting display device 100' further includes a degradation compensator 150 when compared to the organic light-emitting display device 100 of FIG. 1.

The degradation compensator 150 applies compensation data corresponding to an amount of degradation to a degraded pixel. The degradation compensator 150 applies the compensation data to the data driver, and the data driver applies a data signal corresponding to the compensation data to the plurality of pixels PX that are included in the display panel 110 through the data lines DL1 through DLm in response to a data control signal.

The compensation data that is applied from the degradation compensator 150 may be a data voltage that enables a current that is as much as a background current corresponding to a position of the degraded pixel to flow in the degraded pixel.

Alternatively, the compensation data may be image data obtained by adding image data corresponding to the amount of degradation Δ of the degraded pixel that is calculated by the degradation calculator 140 to image data that is to be applied to the degraded pixel.

As a result, the degraded pixel may display an image at a uniform brightness irrespective of degradation of the OLED of the degraded pixel due to the compensation data that is applied by the degradation compensator 150.

Figure 7:
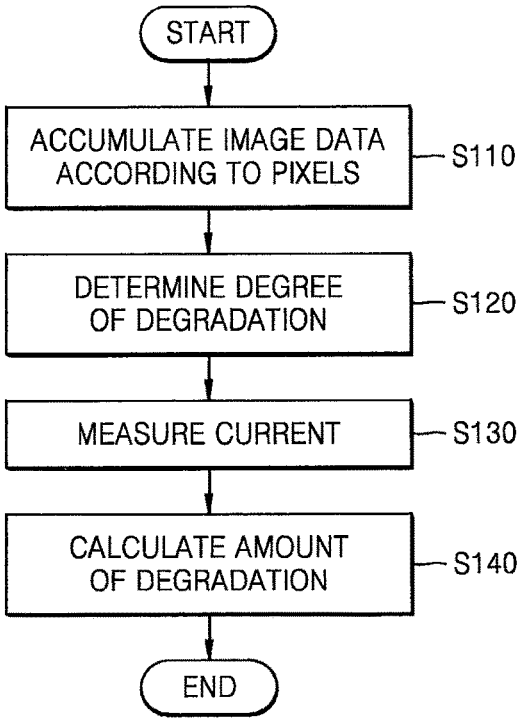
FIG. 7 is a flowchart of a method of driving an organic light-emitting display device, according to an example embodiment.

FIG. 7 is a flowchart of a method of driving an organic light-emitting display device, according to an example embodiment.

The method according to the present example embodiment is a method of driving an organic light-emitting display device including a plurality of pixels, wherein each of the plurality of pixels includes an OLED that emits light of one color from among a plurality of colors including red, green, and blue. The method includes operation S110 in which image data is accumulated and stored according to the pixels, operation S120 in which a degree of degradation of the OLED is determined, operation S130 in which a current that flows in the OLED is measured, and operation S140 in which an amount of degradation of the OLED is calculated.

In operation S110, the image data that is input to each of the plurality of pixels is accumulated and stored according to the pixels. In operation S120, the degree of degradation of the OLED is determined from the accumulated image data.

When the OLED of the organic light-emitting display device receives a driving current corresponding to a data voltage that is applied to a pixel circuit, the OLED emits light at a brightness corresponding to a magnitude of the driving current.

As a time for which the OLED is driven increases, the OLED is degraded due to accumulated stress, and a magnitude of the accumulated stress corresponds to a size of data that is applied to the OLED.

The data may be gray scale data corresponding to a color that is to be represented through light emission of the OLED. When a data voltage corresponding to a high gray scale is applied to the OLED, a size of the gray scale data increases and an amount of the accumulated stress also increases.

Accordingly, in operation S110 and operation S120, the data applied to each of the plurality of pixels, that is, the image data or gray scale data, is accumulated and stored, and a degree of degradation of the pixel is determined from the accumulated and stored data.

In operation S130, a sensing voltage is applied to the OLED and a current corresponding to the sensing voltage is measured. In operation S140, the amount of degradation of the OLED is calculated from the current that is measured in operation S130.

As the OLED is degraded, an internal resistance increases. Accordingly, even when a voltage having the same magnitude as that of a previous one is applied, a current having a less magnitude flows. Accordingly, when a sensing voltage is applied to both ends of an anode and a cathode of the OLED and a current corresponding to the sensing voltage is measured, a difference between currents that are measured in a degraded pixel and a non-degraded pixel may be obtained, and thus an amount of degradation corresponding to the difference between the currents may be calculated.

In order to minimize a measurement error due to an environmental condition such as a temperature, in operation S130, the amount of degradation of the OLED is calculated by using currents that are measured at the same time.

In operation S140, as described above with reference to FIG. 5, a background current may be calculated from currents that are measured in non-degraded pixels from among the plurality of pixels and the amount of degradation may be calculated from a difference between the background and the current that is measured in the degraded pixel.

The background current refers to a current that is predicted to be measured if the degraded OLED is not degraded, and may be calculated from a straight line that couples the currents that are measured in the non-degraded pixels located around the degraded pixel.

In operation S110, a degraded area and a non-degraded area may be separated from the value of accumulated image data that is input to each of the plurality of pixels.

The degree of degradation of the OLED that is included in each pixel may be determined by using the value of accumulated image data or gray scale data that is applied to the pixel, the degraded area and the non-degraded area may be separated according to the degree of degradation, and the amount of degradation of one or more pixels that are included in the non-degraded area may be calculated from a current that is measured in the non-degraded area.

For example, a display panel may be divided into a plurality of display areas including the plurality of pixels, and the non-degraded area and the degraded area may be separated from the value of accumulated image data that is applied to each of the plurality of display areas.

That is, the values of accumulated image data of the plurality of pixels that are included in each of the plurality of display areas may be calculated, and when an average of the values of accumulated image data of the plurality of pixels is equal to or less than a value (e.g., a predetermined value), the display area may be defined as a non-degraded area.

Likewise, when an average of the values of accumulated image data of the plurality of pixels is less than the value (e.g., the predetermined value), the display area may be defined as a degraded area.

In this case, a background current may be calculated from a current that is measured in the non-degraded area, and an amount of degradation of the degraded area may be calculated by using a difference between the background current and a current that is measured in the degraded area.

The method of FIG. 7 may further include applying compensation data corresponding to the amount of degradation to the degraded pixel.

The compensation data may be a data voltage that enables a voltage that is as much as the background current corresponding to a position of the degraded pixel to flow in the degraded pixel.

Alternatively, the compensation data may be image data obtained by adding image data corresponding to the amount of degradation of the degraded pixel that is calculated in operation S140 to image data that is to be applied to the degraded pixel.

As a result, the degraded pixel may display an image at a uniform brightness irrespective of degradation of the OLED of the degraded pixel due to the compensation data.

As described above, according to the one or more of the above example embodiments, there may be provided an organic light-emitting display device and a method of driving the same that may reduce the effects of noise on a display operation to determine an amount of compensation corresponding to a brightness decline due to degradation of an OLED.

While one or more example embodiments have been described with reference to the figures, it will be understood by those of ordinary skill in the art that various changes in form and details may be made therein without departing from the spirit and scope as defined by the following claims, and their equivalents.

What is claimed is:

1. An organic light-emitting display device comprising:

a display panel comprising a plurality of pixels, wherein each of the plurality of pixels comprises an organic light-emitting diode (OLED);

a degradation determiner circuit configured to accumulate a value of image data that is input to each of the plurality of pixels, to determine a degree of degradation of the OLED of the each pixel based on the accumulated value of image data of the each pixel, and to classify the each pixel into a degraded pixel or a non-degraded pixel based on the degree of degradation of the OLED of the each pixel, such that the plurality of pixels are divided into degraded pixels and non-degraded pixels;

a current sensor configured to apply a sensing voltage to the OLED of each of the plurality of pixels and to measure a current of the OLED of the each pixel in response to the sensing voltage; and a degradation calculator configured to calculate a background current based on a current of an OLED of at least one of the non-degraded pixels as measured by the current sensor, and to calculate an amount of degradation of an OLED of each of the degraded pixels based on a difference between the background current and a current of the OLED of the each degraded pixel as measured by the current sensor.

2. The organic light-emitting display device of claim 1, wherein the degradation determiner circuit comprises a memory configured to store the accumulated value of image data of each of the plurality of pixels.

3. The organic light-emitting display device of claim 1, further comprising a degradation compensator circuit configured to apply compensation data to each of the degraded pixels based on the amount of degradation of the OLED of the each degraded pixel.

4. The organic light-emitting display device of claim 1, wherein the current sensor measures the current of the OLED of the at least one of the non-degraded pixels and the current of the OLED of the each degraded pixel at a substantially same time.

5. The organic light-emitting display device of claim 1, wherein the degradation determiner is configured to separate a degradation area including the degraded pixels and a non-degradation area including the non-degraded pixels, based on the accumulated value of image data of each of the plurality of pixels.

6. A method of driving an organic light-emitting display device, the organic light-emitting display device comprising a plurality of pixels, wherein each of the plurality of pixels comprises an organic light-emitting diode (OLED), the method comprising:

accumulating a value of image data that is input to each of the plurality of pixels;

storing the accumulated value of image data of each of the plurality of pixels;

determining a degree of degradation of the OLED of each of the plurality of pixels based on the accumulated value of image data of the each pixel;

classifying each of the plurality of pixels into a degradation pixel or a non-degradation pixel based on the degree of degradation of the OLED of the each pixel such that the plurality of pixels are divided into degraded pixels and non-degraded pixels;

applying a sensing voltage to the OLED of each of the plurality of pixels;

measuring a current of the OLED of each of the plurality of pixels in response to the sensing voltage to generate a current of an OLED of each of the non-degraded pixels and a current of an OLED of each of the degraded pixels;

calculating a background current based on the current of the OLED of at least one of the non-degraded pixels; and calculating an amount of degradation of the OLED of each of the degraded pixels, based on a difference between the background current and the current of the OLED of the each degraded pixel.

7. The method of claim 6, further comprising applying compensation data to each of the degraded pixels based on the amount of degradation of the OLED of the each degraded pixel.

8. The method of claim 6, wherein the current of the OLED of the at least one of the non-degraded pixels and the current of the OLED of the each degraded pixel are measured at a substantially same time.

9. The method of claim 6, wherein the determining of the degree of degradation comprises separating a degradation area including the degraded pixels and a non-degradation area including the non-degraded pixels, based on the accumulated value of image data of each of the plurality of pixels.

10. An organic light-emitting display device comprising:

a display panel comprising a plurality of pixels, wherein each of the plurality of pixels comprises an organic light-emitting diode (OLED) configured to emit light of one color from among a plurality of colors comprising red, green, and blue;

a degradation determiner circuit configured to accumulate a value of image data that is input to each of the plurality of pixels, to determine a degree of degradation of the OLED of the each pixel based on the accumulated value of image data of the each pixel, and to classify the each pixel into a degraded pixel or a non-degraded pixel based on the degree of degradation of the OLED of the each pixel, such that the plurality of pixels are divided into degraded pixels and non-degraded pixels;

a current sensor configured to apply a sensing voltage to the OLED of each of the plurality of pixels and to measure a current of the OLED of the each pixel in response to the sensing voltage; and a degradation calculator configured to calculate a background current predicted to be measured in a degraded pixel if the degraded pixel were not degraded, based on a current that is measured in at least one of the non-degraded pixels from among the plurality of pixels, and to calculate an amount of degradation of the OLED of the degraded pixel by using the background current and the current of the OLED of the degraded pixel as measured by the current sensor.

11. The organic light-emitting display device of claim 1, wherein the degradation calculator is configured to calculate the amount of degradation based on a difference between the background current and the current of the OLED of the degraded pixel.

12. The organic light-emitting display device of claim 1, wherein the degradation calculator is configured to calculate the amount of degradation of the OLED by using currents that are measured at a substantially same time.

* * * * *